US006606977B1

(12) United States Patent
Trotter et al.

(10) Patent No.: US 6,606,977 B1
(45) Date of Patent: Aug. 19, 2003

(54) FLUID DELIVERY LINE GEOMETRY OPTIMIZATION

(75) Inventors: Robert S. Trotter, Waterbury, CT (US); Richard Rustic, Ludlow, MA (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/244,873

(22) Filed: Sep. 17, 2002

(51) Int. Cl.[7] ..... F02M 37/04
(52) U.S. Cl. ..... 123/467; 123/468; 73/119 A
(58) Field of Search ..... 123/467, 468, 123/469, 470, 198 D; 137/565.01; 73/119 A

(56) References Cited

U.S. PATENT DOCUMENTS

| | | | | |
|---|---|---|---|---|
| 4,878,816 A | * | 11/1989 | Tuckey | 417/76 |
| 5,678,521 A | * | 10/1997 | Thompson et al. | 123/447 |
| 6,220,224 B1 | * | 4/2001 | Matthies et al. | 123/468 |
| 6,223,725 B1 | * | 5/2001 | Onishi et al. | 123/447 |
| 6,260,538 B1 | * | 7/2001 | Soteriou | 123/456 |
| 6,289,859 B1 | * | 9/2001 | Fujii et al. | 123/467 |
| 6,360,722 B1 | * | 3/2002 | Onishi | 123/467 |

OTHER PUBLICATIONS

"Deere Enters Small Diesel Business"; "New Integrated Fuel System For Smaller Diesel Engines", Diesel Progress, North American Edition, Mar. 2002.

* cited by examiner

*Primary Examiner*—Carl S. Miller
(74) *Attorney, Agent, or Firm*—Alix, Yale & Ristas, LLP

(57) ABSTRACT

A method for optimizing the geometry of a line providing fluid communication between an outlet of a pump and an inlet, the pump and inlet each having a fixed location, where the pump imposes a periodic pressure pulse on the tubing composing the line. The method comprises the steps of identifying a basic design of the line using conventional industry practices for the specific application and making an initial determination as to the minimum number of bends which are required by the basic line design. If the tubing must be bent, the bend routing is established to best fit the installation constraints set by the design layout, the radii of the bends is maximized within installation constraints using one common radius, a finite element analysis is performed to determine the minimum and maximum loading on the tubing imposed by the expected pressure pulse and the material of the tubing is selected to satisfy design safety factors with the minimal material cost.

6 Claims, 5 Drawing Sheets

FLUID DELIVERY LINE GEOMETRY OPTIMIZATION

BACKGROUND OF THE INVENTION

This invention relates generally to fluid delivery lines providing fluid communication between two fixed locations, the lines being composed of tubing and having one or more bends. More particularly, the present invention relates to the injection line providing fluid communication between an injection pump and an injector of a vehicle having a fuel injection system.

The fuel injection pump and fuel injector or a vehicle fuel injection system are generally both rigidly mounted in place. The injection line providing fluid communication therebetween has been found to be subject to premature failure due to the cyclical stresses imposed thereon by the hydraulic pressure pulses imposed on the injection line by the injection pump. Consequently, such injection lines have been either manufactured of materials having greater resistance to the cyclical stresses or are replaced on a periodic basis. The stress resistant materials are more expensive than the non-stress resistant materials and may be more difficult to manufacture. Periodic replacement of injection lines made from non-stress resistant material is time consuming and requires additional expense.

SUMMARY OF THE INVENTION

Briefly stated, the invention in a preferred form is a method for optimizing the geometry of a line providing fluid communication between an outlet of a pump and an inlet, the pump and inlet each having a fixed location, where the pump imposes a periodic pressure pulse on the tubing composing the line. Such line may be found between a fuel injection pump outlet and a fuel injection nozzle inlet. The method comprises the steps of identifying a basic design of the line using conventional industry practices for the specific application and making an initial determination as to the minimum number of bends which are required by the basic line design. If the tubing can be routed in a straight line from the pump outlet to the inlet with no bends required, a finite element analysis is performed to determine the minimum and maximum loading on the tubing imposed by the expected pressure pulse and the material of the tubing is selected to satisfy design safety factors with the minimal material cost. If the tubing must be bent, the bend routing is established to best fit the installation constraints set by the design layout, a determination is made whether the line may be routed in a single plane instead of in multiple planes, the centerline of the inlet is aligned with the centerline of the pump outlet if allowed by the location and orientation of the discharge end of the line for the proposed bend routing, the quantity of bends is verified to be minimized, the radii of the bends is maximized within installation constraints using one common radius, a finite element analysis is performed to determine the minimum and maximum loading on the tubing imposed by the expected pressure pulse and the material of the tubing is selected to satisfy design safety factors with the minimal material cost.

It is an object of the invention to provide a new and improved method for optimizing the geometry of a line providing fluid communication between an outlet of a pump and an inlet, the pump and inlet each having a fixed location.

It is also an object of the invention to provide a new and improved method for optimizing the geometry of a line providing fluid communication between a fuel injection pump outlet and a fuel injection nozzle inlet.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
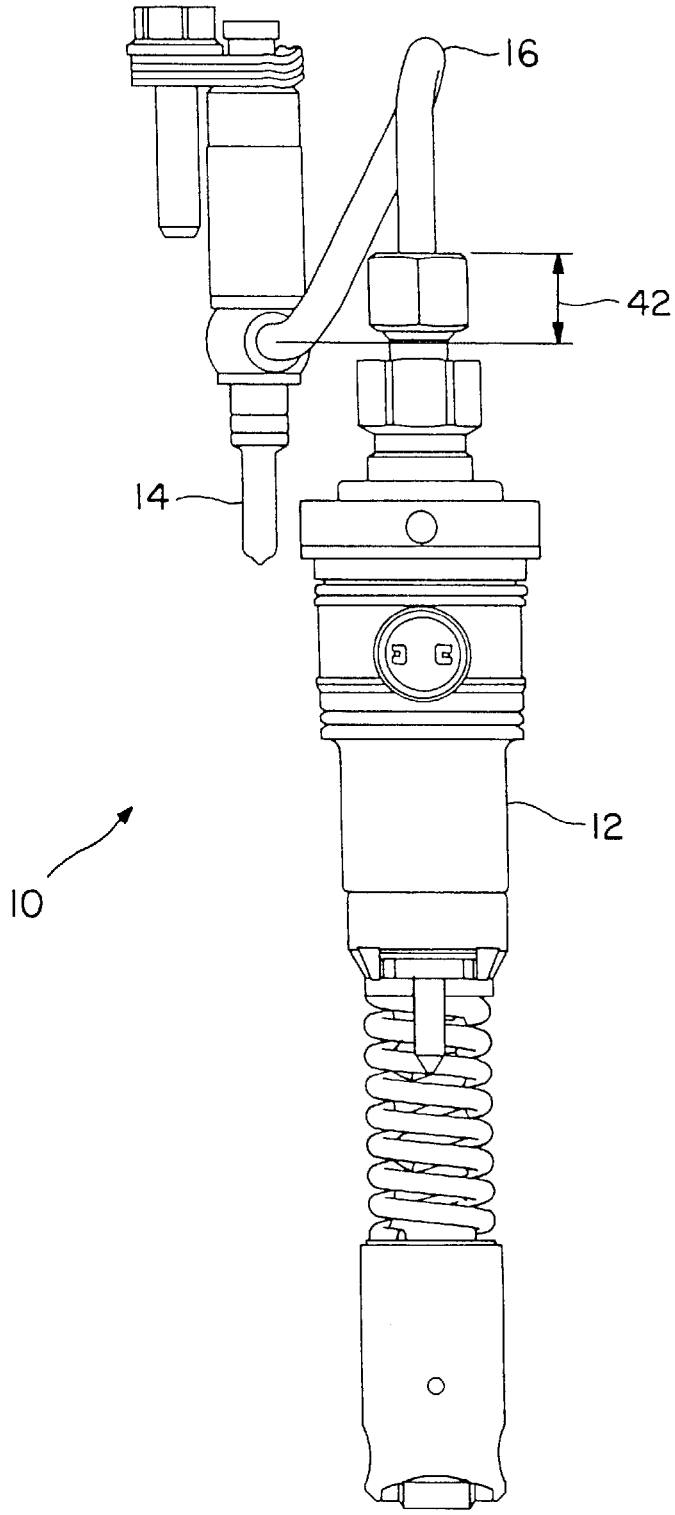
FIG. 1 is a side elevational view of a fuel injection system.
Figure 2:
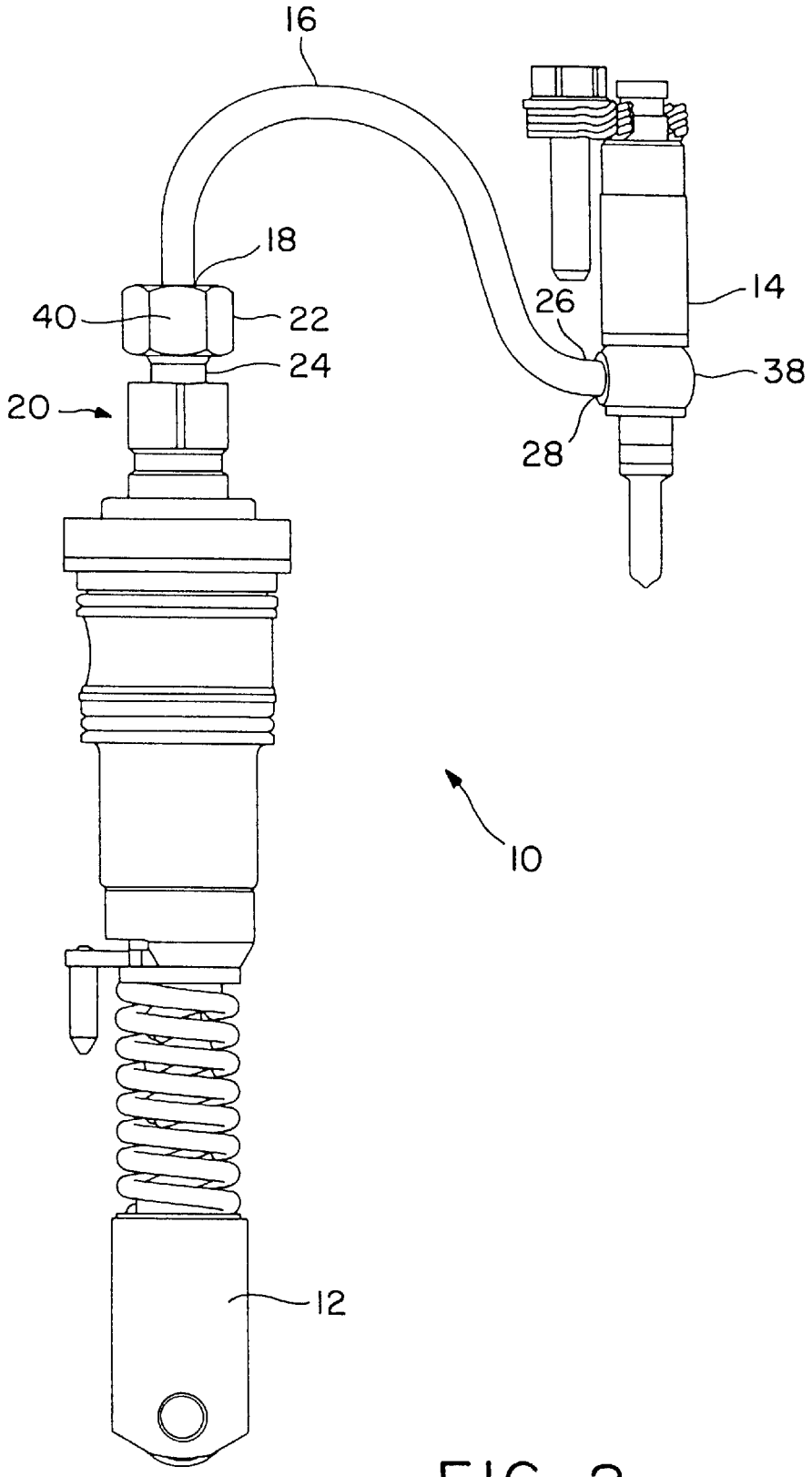
FIG. 2 is a front elevational view of the fuel injection system of FIG. 1.

With reference to FIGS. 1 and 2, fuel injection systems 10include an injection pump 12, an injection nozzle 14, and an injection line 16 providing fluid communication therebetween. The injection line 16 has a first end 18 coupled to the injection pump outlet 20 via a nut 22 and threaded cylinder 24 coupling and a second end 26 which may be coupled to the injection nozzle inlet 28 by another nut and threaded cylinder coupling. Alternatively, the second end 26 of the injection line 16 may be integrally joined to the body of the injection nozzle 14. The injection pump 12 and injection nozzle 14 are both rigidly mounted in place such that the injection pump outlet 20 and injection nozzle inlet 28 are generally not aligned. To provide a flow path between the injection pump outlet 20 and injection nozzle inlet 28 without the necessity for fittings in the injection line 16, the injection line 16is formed from tubing, facilitating the formation of bends in the line.

Figure 4C:
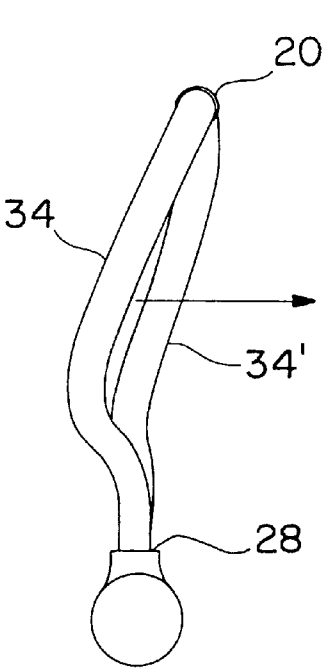
FIGS. 4*a*, 4*b* and 4*c* are schematic top views of the fuel injection system of FIG. 1, illustrating injection pulse induced movement of three injection lines which are identical with the exception of the bend configuration.
Figure 4B:
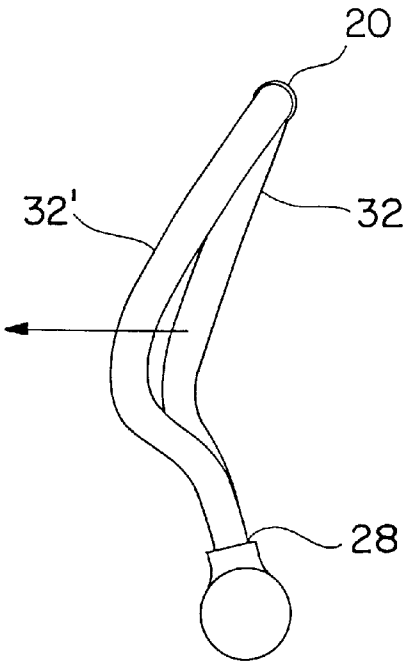
Figure 4A:
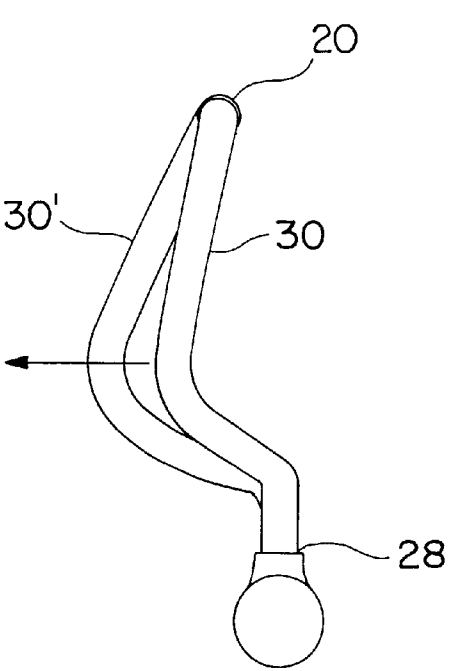

In conventional fuel injection systems, the injection line has been subject to premature failure due to the cyclical stresses imposed by hydraulic pressure pulses in the fuel. During development of an integrated injection nozzle/injection line, it was unexpectedly discovered that the bend geometry and orientation of an injection line 16 between the rigidly mounted end connections has a major influence on the line stresses imparted by the hydraulic pulses. That is, the injection line 16 moves a direction and a distance, with each injection pulse, that largely depend upon the bend configuration of the injection line 16. Such behavior is shown in FIGS. 4*a*, 4*b* and 4*c*, where three injection lines 30, 32, 34 were subjected to the same internal pressure pulse (1500 bar), the injection line 30 of FIG. 4*a* had the greatest degree of initial bending and the injection line 34 of FIG. 4*c* had the least degree of initial bending. Each of the Figures shows the injection line in a static position 30, 32, 34 and in a displaced position 30', 32', 34', with an arrow showing the direction of movement from the static position to the displaced position.

It was further discovered that the major stresses occur where the injection line 16 is joined to the injection nozzle inlet 28, from a torsional loading, and at the pump connection, from a back-and-forth planer loading.

These loadings ultimately resulted in a fatigue failure in the finite element analysis predicted highest stress areas. The stresses and safety factors (FS) of these variables are shown in Table 1 for three different line materials, various pressure levels, and various tubing bends. Table 1*a* illustrates that the stress at both ends of the injection line 16 must be evaluated due to the difference in the dynamics at each end. By optimizing the bend geometry, the dynamic loadings of the line 16 can be minimized to acceptable levels in a most cost effective manner.

Figure 3:
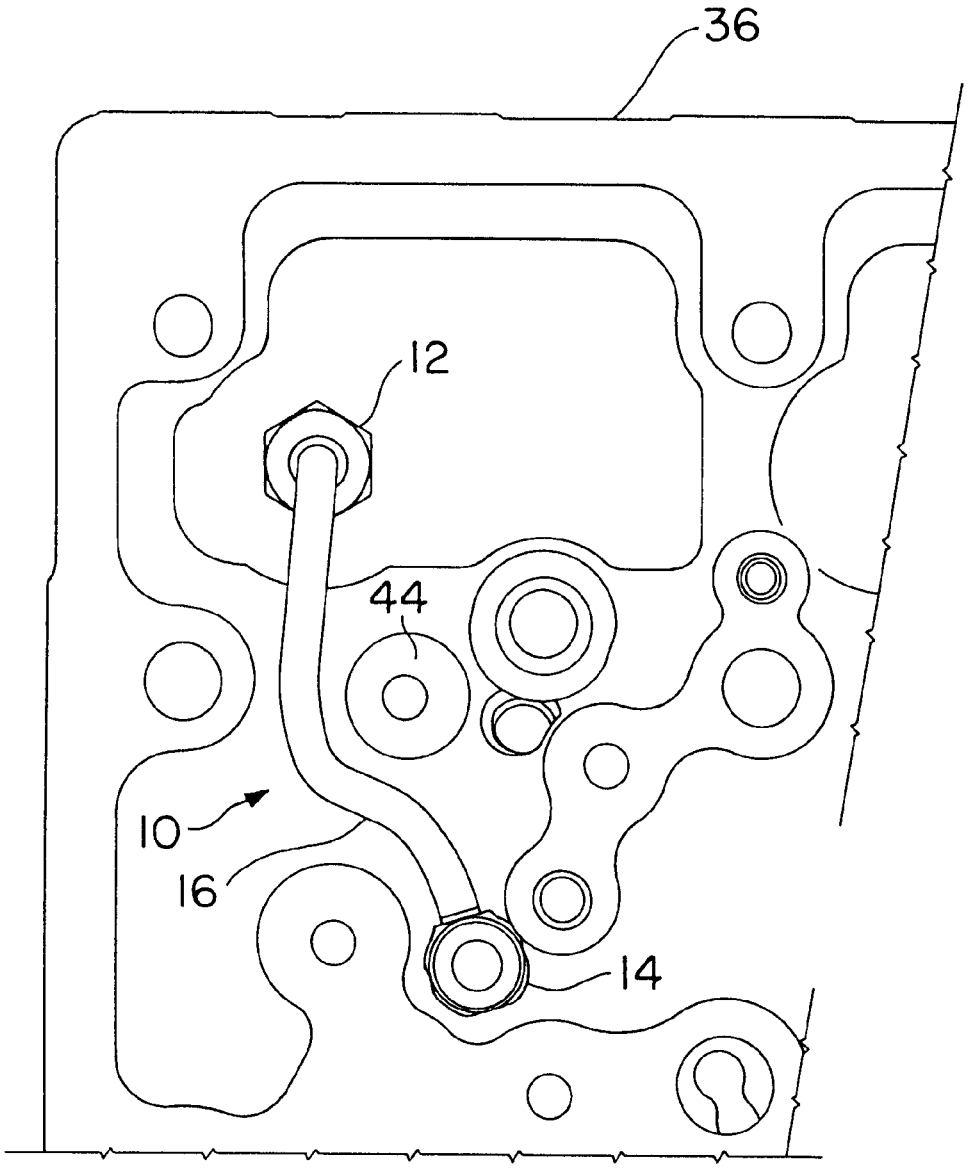
FIG. 3 is a partial top view of an engine having the fuel injection system of FIG. 1, illustrating an injection line configured in accordance with the invention.

With reference to FIG. 3, both the injection pump 12 and injection nozzle 14 are generally mounted on the engine 36 which is served by the fuel injection system 10. Since the engine design determines the position of the centerlines 38, 40 of the injection nozzle inlet 28 and the injection pump outlet 20, such design imposes constraints on the geometry of the injection line 16. Any elevational differences 42 between the injection nozzle inlet 28 and the injection pump outlet 20 imposed by the design of the injection nozzle 14, injection pump 12 or engine 36 also impose constraints on the geometry of the injection line. Finally, headroom limitations and interfering engine/engine compartment components 44 may also impose constraints on the geometry of the injection line 16.

Figure 5:
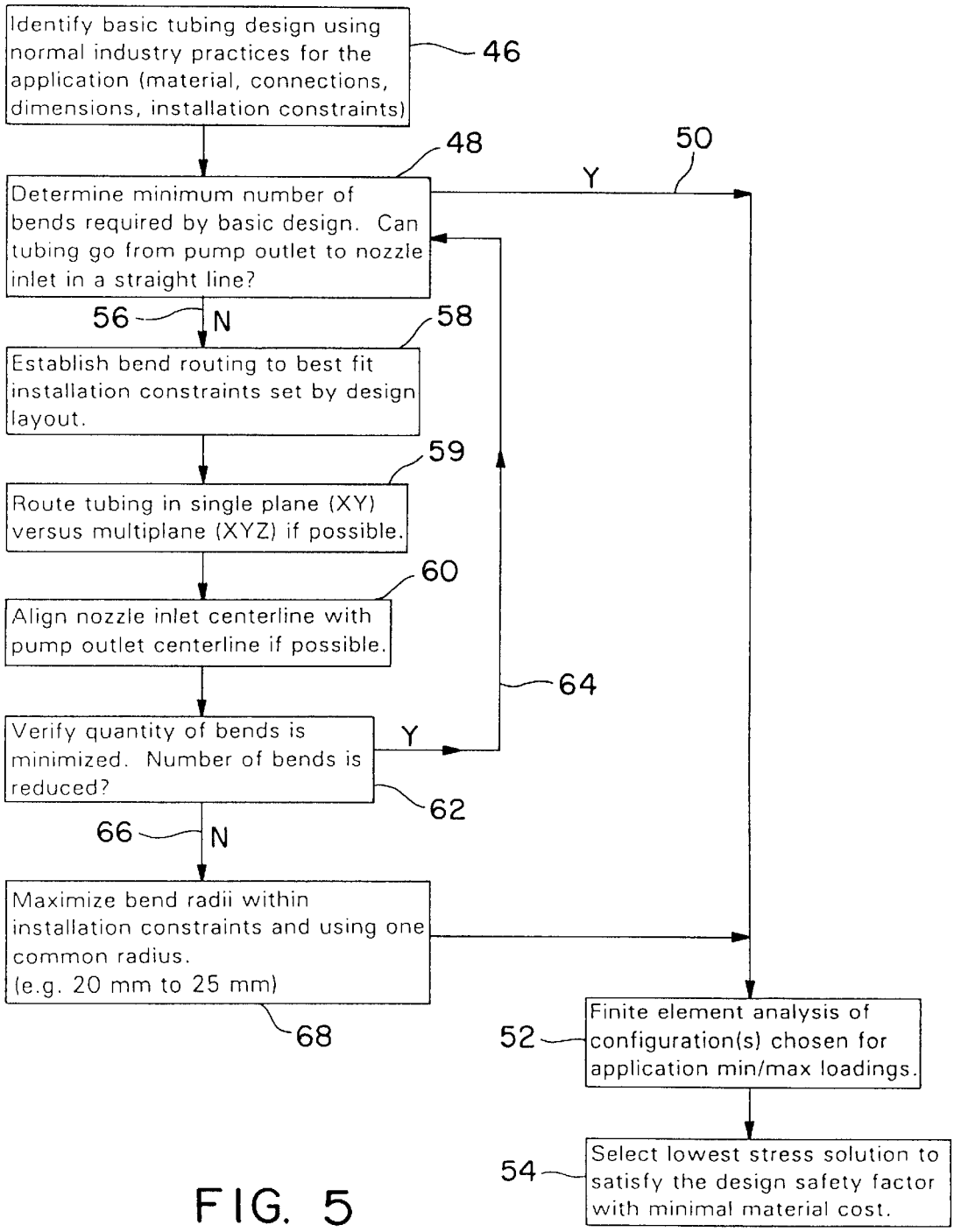
FIG. 5 is a flow diagram illustrating the subject method of injection line geometry optimization.

As shown in FIG. 5, the method of optimizing the geometry of the injection line starts with identifying the basic design of the tubing 46 using conventional industry practices for the specific application. Basic design considerations include installation constraints (as discussed above), the type of end connections that will be utilized, and the tubing dimensions. Once the basic tubing design has been identified, an initial determination is made 48 as to the minimum number of bends which are required by the basic tubing design. If the tubing can be routed in a straight line from the injection pump outlet to the injection nozzle inlet 50 (no bends required), a finite element analysis is performed 52 to determine the minimum and maximum loading on the tubing imposed by the expected pressure pulse. The material of the tubing is then selected 54 to satisfy the design safety factor with the minimal material cost. If the tubing must be bent 56, the bend routing to best fit the installation constraints set by the design layout is established 58. A determination is made as to whether the tubing may be routed in a single plane (XY) instead of in multiple planes (XYZ) 59. The centerline of the injection nozzle inlet is aligned with the centerline of the injection pump outlet 60if allowed by the location and orientation of the discharge end 26 of the injection line 16 for the proposed bend routing. The proposed bend routing is then evaluated to verify that such routing provides for the fewest number of bends in the tubing 62. If an alternate route is available which provides for fewer bends 64, it is evaluated in accordance with steps 48, 50, 56, 58, 60, 62 above. If there are no alternate routes providing a fewer number of bends 66, the radii of the bends are maximized within installation constraints using one common radius 68. After the bend radii is maximized, a finite element analysis is performed 52 to determine the minimum and maximum loading on the tubing imposed by the expected pressure pulse for each possible configuration of the tubing. The lowest stress solution is then selected 54 which will satisfy the design safety factor with the minimal material cost.

It should be appreciated that the method described above may be applied to any fluid delivery line which provides fluid communication between two fixed points and which is subject to internal pressure pulses. In addition, while preferred embodiments have been shown and described, various modifications and substitutions may be made thereto without departing from the spirit and scope of the invention. Accordingly, it is to be understood that the present invention has been described by way of illustration and not limitation.

TABLE 1a

| | Connector End | | | | | | Swage End | | | | | |
|---|---|---|---|---|---|---|---|---|---|---|---|---|
| PIP (bar) | Max TS (psi) | Equiv mean stress (psi) | Equiv range stress (psi) | FEA FS used in EAR | FS std tube after HT | FS premium tube aft HT | Max TS (psi) | Equiv mean stress (psi) | Equiv range stress (psi) | FEA FS used in EAR | FS std tub after HT | FS premium tube aft HT |
| 1500 | | | | | | | | | | | | |
| Initial (6.35) | 4356 | 1927 | 1927 | 7.57 | 7.85 | 16.77 | 15818 | 7065 | 7065 | 2.06 | 2.14 | 4.57 |
| Gen 0 (6.35) | 49807 | 29225 | 29225 | 0.50 | 0.52 | 1.11 | 42460 | 19636 | 19630 | 0.74 | 0.77 | 1.65 |
| Gen 1 (6) | 29989 | 19385 | 19385 | 0.75 | 0.78 | 1.67 | 45260 | 20785 | 20785 | 0.70 | 0.73 | 1.55 |
| Gen 1 (6.35) | 28150 | 18340 | 18340 | 0.80 | 0.83 | 1.76 | 34267 | 15905 | 15905 | 0.92 | 0.95 | 2.03 |
| Gen 2 (6.35) | 19088 | 10945 | 10945 | 1.33 | 1.38 | 2.95 | 10909 | 5050 | 5050 | 2.89 | 3.00 | 6.40 |
| 1200 | | | | | | | | | | | | |
| Gen 0 (6.35) | 39846 | 23380 | 23380 | 0.62 | 0.65 | 1.38 | 33968 | 15704 | 15704 | 0.93 | 0.96 | 2.06 |
| Gen 1 (6) | 23991 | 15508 | 15508 | 0.94 | 0.98 | 2.08 | 36208 | 16628 | 16628 | 0.88 | 0.91 | 1.94 |
| Gen 1 (6.35) | 22520 | 14672 | 14672 | 0.99 | 1.03 | 2.20 | 27414 | 12724 | 12724 | 1.15 | 1.19 | 2.54 |
| Gen 2 (6.35) | 15270 | 8756 | 8756 | 1.67 | 1.73 | 3.69 | 8727 | 4040 | 4040 | 3.61 | 3.75 | 8.00 |
| 1000 | | | | | | | | | | | | |
| Gen 0 (6.35) | 33205 | 19483 | 19483 | 0.75 | 0.78 | 1.66 | 28307 | 13087 | 13087 | 1.11 | 1.16 | 2.47 |
| Gen 1 (6) | 19993 | 12923 | 12923 | 1.13 | 1.17 | 2.50 | 30173 | 13857 | 13857 | 1.05 | 1.09 | 2.33 |
| Gen 1 (6.35) | 18767 | 12227 | 12227 | 1.19 | 1.24 | 2.64 | 22845 | 10603 | 10603 | 1.38 | 1.43 | 3.05 |
| Gen 2 (6.35) | 12725 | 7297 | 7297 | 2.00 | 2.07 | 4.43 | 7273 | 3367 | 3367 | 4.33 | 4.50 | 9.60 |
| 800 | | | | | | | | | | | | |
| Gen 0 (6.35) | 26564 | 15587 | 15587 | 0.94 | 0.97 | 2.07 | 22645 | 10469 | 10469 | 1.39 | 1.45 | 3.09 |
| Gen 1 (6) | 15994 | 10339 | 10339 | 1.41 | 1.46 | 3.13 | 24139 | 11085 | 11085 | 1.32 | 1.37 | 2.92 |
| Gen 1 (6.35) | 15013 | 9781 | 9781 | 1.49 | 1.55 | 3.30 | 18276 | 8483 | 8483 | 1.72 | 1.78 | 3.81 |
| Gen 2 (6.35) | 10180 | 5837 | 5837 | 2.50 | 2.59 | 5.54 | 5818 | 2693 | 2693 | 5.41 | 5.62 | 12.00 |
| tube | US (psi) | YS (psi) | | | EL (psi) | | | | | | | |

TABLE 1a-continued

| | Connector End | | | | | | Swage End | | | | | |
|---|---|---|---|---|---|---|---|---|---|---|---|---|
| PIP (bar) | Max TS (psi) | Equiv mean stress (psi) | Equiv range stress (psi) | FEA FS used in EAR | FS std tube after HT | FS premium tube aft HT | Max TS (psi) | Equiv mean stress (psi) | Equiv range stress (psi) | FEA FS used in EAR | FS std tub after HT | FS premium tube aft HT |
| FEA | 50000 | 35000 | | | 25000 | < after HT | | | | | | |
| P&P std | 56000 | 32933 | | | 28000 | < MRR ave values after HT | | | | | | |
| P&P premium | 103667 | 85833 | | | 51834 | < MRR ave values after HT | | | | | | |

TABLE 1b

| | Internal Hoop Stress (1.6 mm ID) | | | | |
|---|---|---|---|---|---|
| PIP (bar) | Max TS (psi) | Equiv mean & range S (psi) | FEA FS used in EAR | FS std tube after HT | FS premium tube aft HT |
| 1500 | | | | | |
| Straight (6.35) | 36377 | 18189 | 0.80 | 0.83 | 1.78 |
| Gen 0 (6.35) | 36377 | 18189 | 0.80 | 0.83 | 1.78 |
| Gen 1 (6) | 29989 | 19385 | 0.75 | 0.78 | 1.67 |
| Gen 1 (6.35) | 36377 | 18189 | 0.80 | 0.83 | 1.78 |
| Gen 2 (6.35) | 36377 | 18189 | 0.80 | 0.83 | 1.78 |
| 1200 | | | | | |
| Gen 0 (6.35) | 29102 | 14551 | 1.00 | 1.04 | 2.22 |
| Gen 1 (6) | 23991 | 15508 | 0.94 | 0.98 | 2.08 |
| Gen 1 (6.35) | 29102 | 14551 | 1.00 | 1.04 | 2.22 |
| Gen 2 (6.35) | 29102 | 14551 | 1.00 | 1.04 | 2.22 |
| 1000 | | | | | |
| Gen 0 (6.35) | 24251 | 12126 | 1.20 | 1.25 | 2.67 |
| Gen 1 (6) | 19993 | 12923 | 1.13 | 1.17 | 2.50 |
| Gen 1 (6.35) | 24251 | 12126 | 1.20 | 1.25 | 2.67 |
| Gen 2 (6.35) | 24251 | 12126 | 1.20 | 1.25 | 2.67 |
| 800 | | | | | |
| Gen 0 (6.35) | 19401 | 9701 | 1.50 | 1.56 | 3.33 |
| Gen 1 (6) | 15994 | 10339 | 1.41 | 1.46 | 3.13 |
| Gen 1 (6.35) | 19401 | 9701 | 1.50 | 1.56 | 3.33 |
| Gen 2 (6.35) | 19401 | 9701 | 1.50 | 1.56 | 3.33 |
| tube | US (psi) | YS (psi) | | EL (psi) | |
| FEA | 50000 | 35000 | | 25000 | < after HT |
| P&P std | 56000 | 32933 | | 28000 | < MRR ave values after HT |
| P&P premium | 103667 | 85833 | | 51833.5 | < MRR ave values after HT |

What is claimed is:

1. A method for optimizing the geometry of a line providing fluid communication between an outlet of a pump and an inlet, the pump and inlet each having a fixed location, the line being composed of tubing, the pump imposing a periodic pressure pulse on the tubing, the method comprising the steps of:

a) identifying a basic design of the line using conventional industry practices for the specific application;

b) making an initial determination as to the minimum number of bends which are required by the basic line design, 1) advancing to step (c) if the tubing can be routed in a straight line from the pump outlet to the inlet with no bends required, 2) if the tubing must be bent, i) establishing the bend routing to best fit the installation constraints set by the design layout, ii) verifying that the quantity of bends is minimized and returning to step (b) if the number of bends may be reduced;

c) performing a finite element analysis to determine the minimum and maximum loading on the tubing imposed by the expected pressure pulse; and d) selecting the material of the tubing to satisfy design safety factors with the minimal material cost.

2. The method of claim 1 wherein intermediate sub-steps (i) and (ii), step (b)(2) also comprises the sub-step of aligning the centerline of the inlet with the centerline of the pump outlet if allowed by the location and orientation of the discharge end of the line for the proposed bend routing.

3. The method of claim 1 wherein intermediate sub-steps (i) and (ii), step (b)(2) also comprises the sub-step of determining whether the line may be routed in a single plane instead of in multiple planes.

4. The method of claim 1 wherein after sub-step (ii), step (b)(2) also comprises the sub-step of maximizing the radii of the bends within installation constraints.

5. The method of claim 4 wherein the radii of the bends is maximized using one common radius.

6. A method for optimizing the geometry of a line providing fluid communication between an outlet of a pump and an inlet, the pump and inlet each having a fixed location, the line being composed of tubing, the pump imposing a periodic pressure pulse on the tubing, the method comprising the steps of:

a) identifying a basic design of the line using conventional industry practices for the specific application;

b) making an initial determination as to the minimum number of bends which are required by the basic line design, 1) advancing to step (c) if the tubing can be routed in a straight line from the pump outlet to the inlet with no bends required, 2) if the tubing must be bent, i) establishing the bend routing to best fit the installation constraints set by the design layout, ii) determining whether the line may be routed in a single plane instead of in multiple planes, iii) aligning the centerline of the inlet with the centerline of the pump outlet if allowed by the location and orientation of the discharge end of the line for the proposed bend routing, iv) verifying that the quantity of bends is minimized and returning to step (b) if the number of bends may be reduced v) maximizing the radii of the bends within installation constraints using one common radius;

c) performing a finite element analysis to determine the minimum and maximum loading on the tubing imposed by the expected pressure pulse; and d) selecting the material of the tubing to satisfy design safety factors with the minimal material cost.

* * * * *